US009038215B2

(12) United States Patent
Al-Jafar

(10) Patent No.: US 9,038,215 B2
(45) Date of Patent: May 26, 2015

(54) BED WITH INTEGRAL TOILET

(76) Inventor: Ahmed I. S. I. Al-Jafar, Al-Quran (KW)

( * ) Notice: Subject to any disclaimer, the term of this patent is extended or adjusted under 35 U.S.C. 154(b) by 0 days.

(21) Appl. No.: 13/613,315

(22) Filed: Sep. 13, 2012

(65) Prior Publication Data

US 2014/0068862 A1 Mar. 13, 2014

(51) Int. Cl.

| | |
|---|---|
| ***A61G 7/02*** | (2006.01) |
| ***A61G 9/00*** | (2006.01) |
| ***A61G 7/015*** | (2006.01) |

(52) U.S. Cl.

CPC *A61G 9/003* (2013.01); *A61G 7/02* (2013.01); *A61G 7/015* (2013.01); *Y10S 5/928* (2013.01)

(58) Field of Classification Search

USPC ..... 5/695, 606, 694, 454, 449, 450, 479, 5/604, 605

See application file for complete search history.

(56) References Cited

U.S. PATENT DOCUMENTS

| | | | | |
|---|---|---|---|---|
| 2,500,743 | A | 3/1950 | Beem et al. | |
| 3,943,583 | A | 3/1976 | Ishikawa | |
| 5,077,845 | A * | 1/1992 | Tokunaga et al. | 5/605 |
| 5,350,369 | A | 9/1994 | Workman et al. | |
| 5,513,404 | A | 5/1996 | Kanai | |
| 5,685,034 | A * | 11/1997 | Kleer et al. | 5/604 |
| 5,842,237 | A * | 12/1998 | Hargest et al. | 5/606 |
| 5,926,875 | A | 7/1999 | Okamoto et al. | |
| 6,009,570 | A | 1/2000 | Hargest et al. | |
| 6,101,646 | A | 8/2000 | Son | |
| 8,302,226 | B2 * | 11/2012 | Hu et al. | 5/604 |
| 2013/0185870 | A1 * | 7/2013 | Ishida | 5/604 |

* cited by examiner

*Primary Examiner* — Peter M Cuomo
*Assistant Examiner* — Brittany Wilson
(74) *Attorney, Agent, or Firm* — Lowe Hauptman Ham, LLP

(57) ABSTRACT

A bed with an integral toilet includes a frame, a mattress and a support for supporting the mattress on the bed frame. The mattress and support define an opening extending through the mattress and support. A robotic system removes and replaces a cushion for filling the opening and for replacing the toilet in alignment with the opening. An integral bidet, a source of clean water, a nozzle, a variable speed pump and mechanism for connecting a source of water to the bidet are included. A second opening in a lower portion of the toilet is connected to a waste storage tank. An odor eliminator is provided and a remote control allows a patient to control the unit.

10 Claims, 5 Drawing Sheets

BED WITH INTEGRAL TOILET

FIELD OF THE INVENTION

This invention related to a bed with an integral toilet for a bed ridden patient and more particularly to a bed with an integral toilet, bidet and nozzle for washing and drying a portion of a patient and cleaning the toilet and disposing of waste.

BACKGROUND OF THE INVENTION

Beds with commodes are well known and have been in use for many years. For example, a U.S. patent of Ishikawa, U.S. Pat. No. 3,943,583 discloses a bed with a commode or stool having a main mattress provided with a through-hole in which the commode and mattress may be positioned alternately by manipulation of an operating panel mounted at or near the bed. The front part of the main mattress may be erected along a transverse fold line so as to serve a reclining position.

A more recent U.S. patent of Okamoto et al., U.S. Pat. No. 5,926,875 discloses a nursed person's bed with a flush toilet. As disclosed, a bed, in combination with a flush toilet has a bed body provided with an opening. The opening has a width which is sufficient to accommodate the hips of a sick or disabled person laying on the bed. The opening can be opened and closed by a cover. The cover can be withdrawn from a retracted position where it is accommodated on the back of the bed body to close the opening. A flush toilet is disposed below the opening. A toilet seat is disposed in the opening and has a somewhat cylindrical excreta guide for reliably guiding excreta into the flush toilet. The toilet seat can be tilted about a vertical axis by a lift. Also, the toilet seat's free end is tilted upward so as to be in close contact with the hips of the sick or disabled person.

Finally, a U.S. patent of Son, U.S. Pat. No. 6,101,646 discloses a dual-function folding bed used as a chair equipped with a patient toilet. The Son patent discloses a dual-function bed used as a chair and equipped with a patient toilet. The bed is designed to be selectively used as a chair by controlling the folding angle of it with the operation of a reduction motor. Moreover, as attached equipment, the toilet having the capabilities of cleaning itself and discharging excrement, provides great convenience to a patient. Subsequently, the invention allows a disabled and non-ambulatory patient to relieve oneself and rest by simply operating a control unit without a nurse.

Notwithstanding the above, it is presently believed that there is a need and a potential commercial market for an improved bed with an integral toilet for a bed ridden patient in accordance with the present invention. There should be a commercial market for such beds because they include means for washing and drying a patient's body after a bed ridden relieves themselves of human waste, for cleaning the toilet, eliminating odor and storing waste and water for a reasonable period of time. It is also believed that the bed and integral toilet in accordance with the present invention can be produced at a reasonably competitive cost, is easily serviced, sturdy, easily used and yet comfortable for the bed ridden patient.

BRIEF SUMMARY OF THE INVENTION

In essence the present invention contemplates a bed with an integral toilet for a bed ridden patient. The bed comprises or consists of:

a bed having a frame, a mattress, and a support for supporting the mattress on the bed frame and wherein the mattress and support define a first opening extending through the mattress and support and an intermediate portion thereof;

a robotic system removes and replaces a cushion for filling the first opening and for removing and replacing the toilet in alignment with the first opening;

a flush toilet disposed underneath said first opening and including an integral bidet, a source of clean water, a nozzle, a variable speed pump and means for connecting said source of clean water, the bidet and the nozzle;

a second opening in the lower portion of said toilet, a water disposal line in a building or a waste storage tank and a conduit connecting the second opening and the waste storage chamber for receiving waste and water from the toilet, means for absorbing odor from the waste and means for closing the chamber;

means for directing clean water from the bidet onto the patient for cleaning the patient;

a hot air dryer including means for directing hot air onto a portion of a patient for drying any water remaining on the patient from the bidet;

an odor eliminator adjacent the toilet; and a remote control device for delivering water to the bidet and the nozzles for cleaning a patient and the toilet and for opening and closing the first and second openings.

The invention will now be described in connection with the accompanying figures wherein like reference numerals have been used to indicate like parts.

DESCRIPTION OF THE PREFERRED EMBODIMENTS OF THE INVENTION

Figure 1:
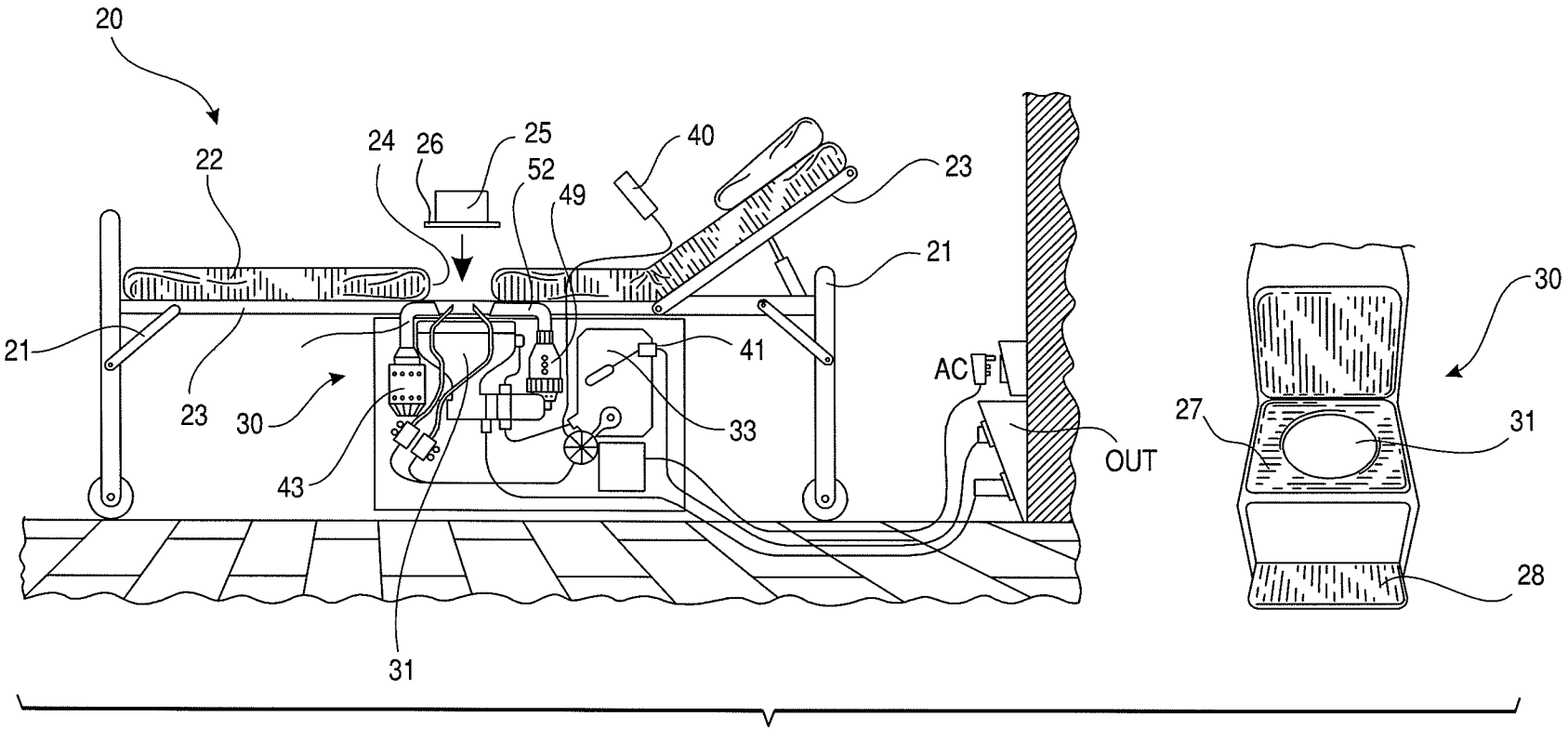
FIG. 1 is a side elevational view of a partially broken away bed with integral toilet unit for a bed ridden patient and includes an alternative embodiment wherein the toilet is on one side of the bed.

As illustrated in FIG. 1, a bed 20 with a toilet 30 includes a frame 21 with a mattress 22, and mattress support 23. The mattress includes an opening 24 in an intermediate portion thereof and a cushion 25 that fills the opening 24 and is fixed to the top or cover 26 that pivots upwardly in a conventional manner. An individual, as for example, a bed ridden patient sits upright on the bed with their legs over the side of the bed and lifts the cover 26 and moves over to sit on a toilet seat 27 with his feet on a foot support 28 in order to use the toilet 30. A remote control unit 40 may hang at a convenient location of a bed frame 21.

Figure 2:
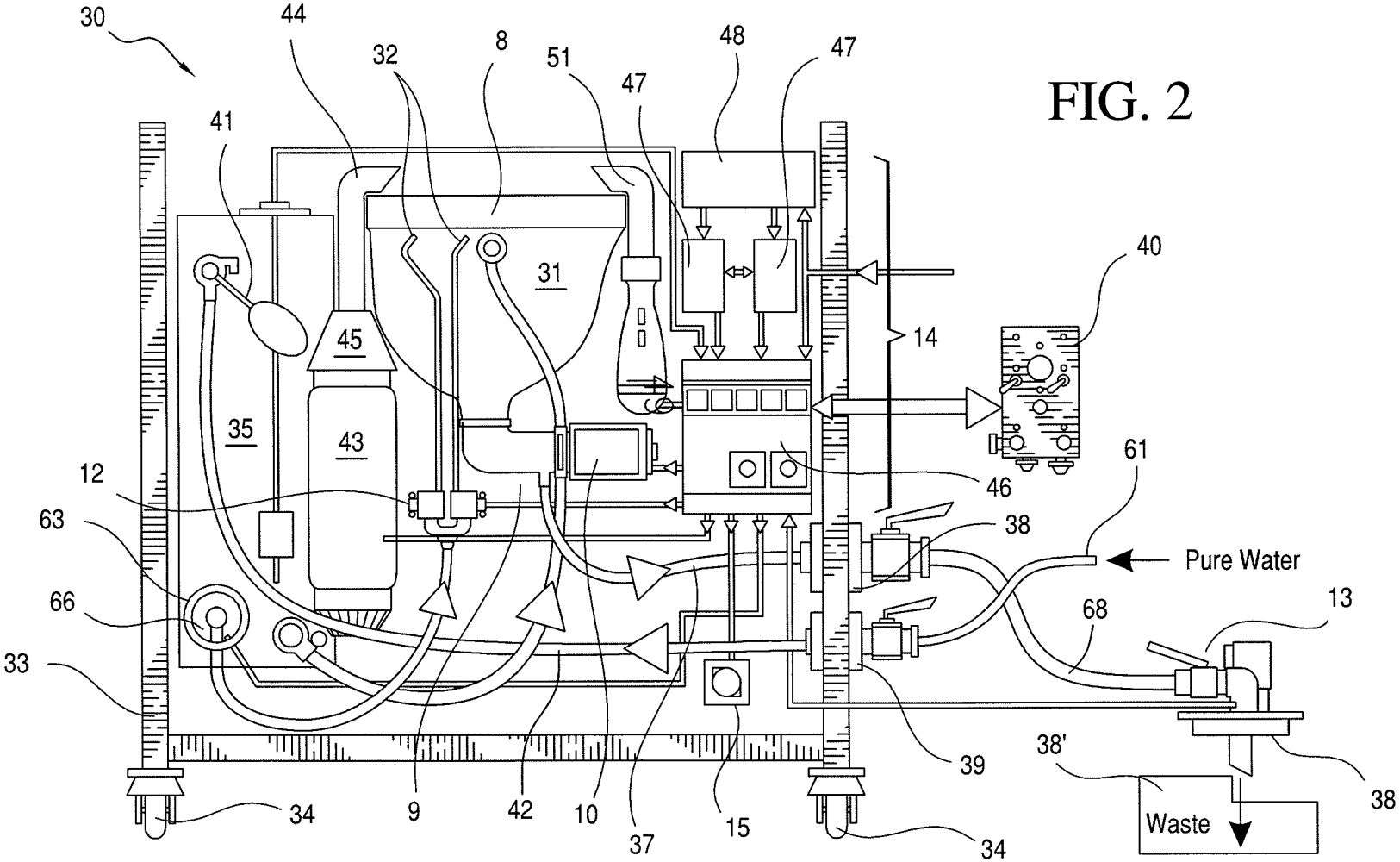
FIG. 2 is a side elevational view of a partially broken away bed with an integral toilet wherein the mechanical elements of a toilet module are shown.

The toilet 30 will now be described in connection with FIGS. 1 and 2 and includes a toilet bowl 31 that serves as a bathing portion of the bidet that also includes a nozzle pair 32 (FIG. 2) for washing and cleaning the anterior and posterior parts of the body. One or more nozzles 32 may also be provided for cleaning the bowl 31 by flushing water over the entire surface of the bowl 31. As shown in FIG. 2, the toilet 30 is carried on a wheeled frame assembly 33 that rests on four wheels 34, only two of which are shown in FIG. 2. The toilet 30 and assembly 33 can be removed or replaced for cleaning, maintenance or if needed for a new patient in a multi-bed facility.

The toilet includes a water closet or first chamber 35 that contains a supply of clean water used with an electric pump 63 for ejecting water out of the nozzles 32. The bowl 31 also includes an opening into a conduit 37 for emptying waste or water into a second chamber 38', sewer line or the like as for example through an outlet or valve 38. A pure water inlet 39 is connected to a source of clean water for replenishing the water closet or first chamber 35 with water passing through a conduit or flexible tube 42 as long or whenever a float valve 41 is in an open position. The mechanism for the float valve 41 is conventional and works in the same manner as those used in conventional toilets.

A vacuum machine 43 draws air from and around the toilet bowl 31 into a conduit 44 and through an odor absorbing filter 45 and is activated by a remote control 40 and an electrical control module 46. The electric control module 46 may be powered by two 12V batteries 47 that are each energized by a battery charger 48 that are connected to a source of electricity. On or about the same time, a hot air dryer 49 directs warm air through a conduit 51 to dry the back side of an individual. The bed with an integral toilet includes a plurality of DC motors for energizing and operating the bed and toilet.

The hot or warm air dryer 49 is activated by the remote control 40 that activates the electrical control module 46.

Figure 3B:
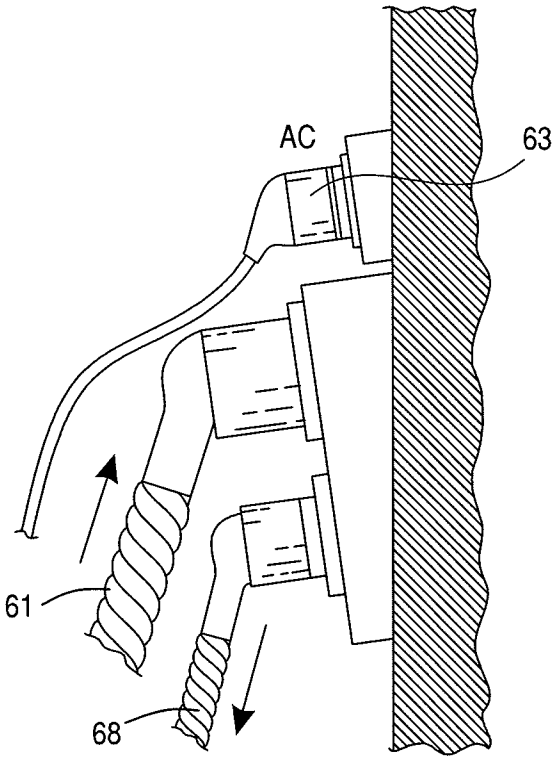
FIG. 3B is a side elevational view of a water inlet and disposal and electrical connection in accordance with one embodiment of the invention.
Figure 3A:
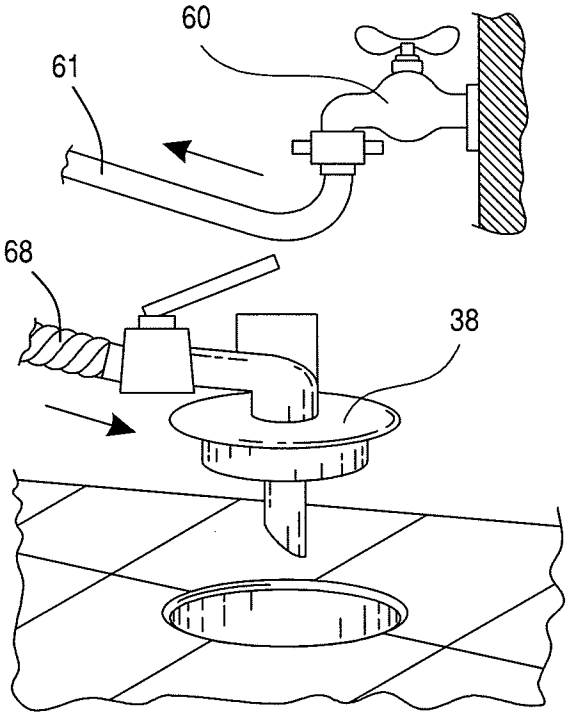
FIG. 3A is side elevational view of a water source and sewage disposal in accordance with a first embodiment of the invention.

Referring now to FIGS. 3A and 3B, the water closet is connected to a conventional clean water outlet 60 by a flexible conduit 61 and 42 through a valve assembly 39 that can be used to shut off the supply of water when a toilet is removed from the bed. In addition, liquefied waste and cleaning water is fed through a valve 38 to a chamber 38' or into a sewage line.

FIG. 3B shows a connection of the module to a conventional connector 63 to a source of alternating current for providing power to energize the hot hair dryer vacuum and motor and battery charger.

An electronically controlled variable speed motor 66 drives a water pump 63 and adjusts and controls the pressure for nozzles 32. The multi-function pump 9 flushes pure water into the bowl 31 for cleaning, and blends the clean water used for cleaning with the waste to liquefy the waste and discharge the liquefied waste. Pump 9 is driven by an electric motor 10.

Figure 4:
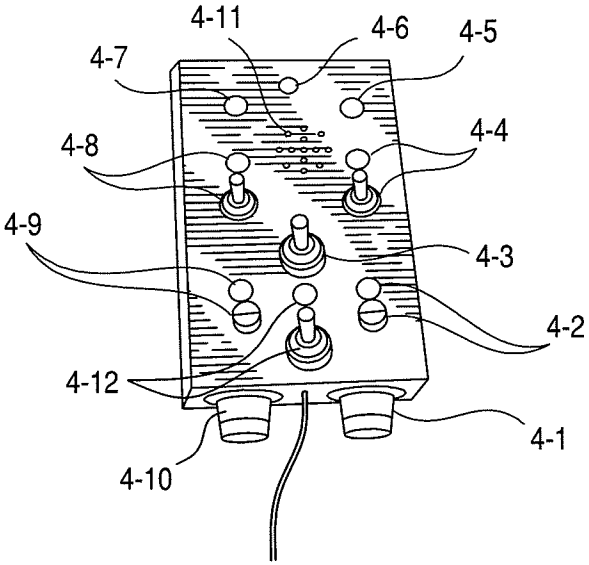
FIG. 4 is a schematic illustration for a remote control unit for use in the present invention.

As illustrated in FIG. 4, a remote control unit 40 for use by a patient and/or by a nurse is connected to the electrical control unit 46 by a multi-core cable 62, the remote control unit 40 gives orders to the electrical control unit 46 to power the various components in the system, namely the drive wheels, means for raising and lowering a cushion, water pump, dryer and odor remover that includes an actuated aromatic spray upon flushing the toilet. The remote control unit includes an on/off switch 4-3 which is used to turn the power on or off. A knob 4-1 controls the speed of the water pump to control the pressure of the water fed to the cleaning nozzle pair 32. Further, push button 4-2 actuates a two-way valve 12 (FIG. 2) to direct cleaning water to the front nozzle of the nozzle pair 32, while the associated light indicates this state. Further a push button 4-9 actuates the two way valve 12 to direct cleaning water to the back nozzle of the nozzle pair 32 while the associate light indicates this state. Still further a switch 4-4 turns the hot air dryer on or off, and the associated light indicates its state. In addition, a warning light 4-5 indicates that the 12V batteries 47 need charging while a light 4-7 indicates that the batteries are fully charged. A warning light 4-6 indicates whether the unit is on or off. Still further a knob 4-10 is used to regulate the pressure of the cleaning water while a speaker 4-11 advises a patient when the positioning of the toilet has been completed and gives a warning alarm if the discharge outlet valve 13 (FIG. 2) is closed. Finally, a two way switch 4-12 with a dual light is used to energize the robot system to remove the cushion and position the toilet module for use and the other through the switch moves the toilet away and returns the cushion to its normal position. The associated dual light indicates the status of the robot. Other sub-systems can be added as desired. For example, the odor eliminator may be actuated independently of the toilet.

Figure 5:
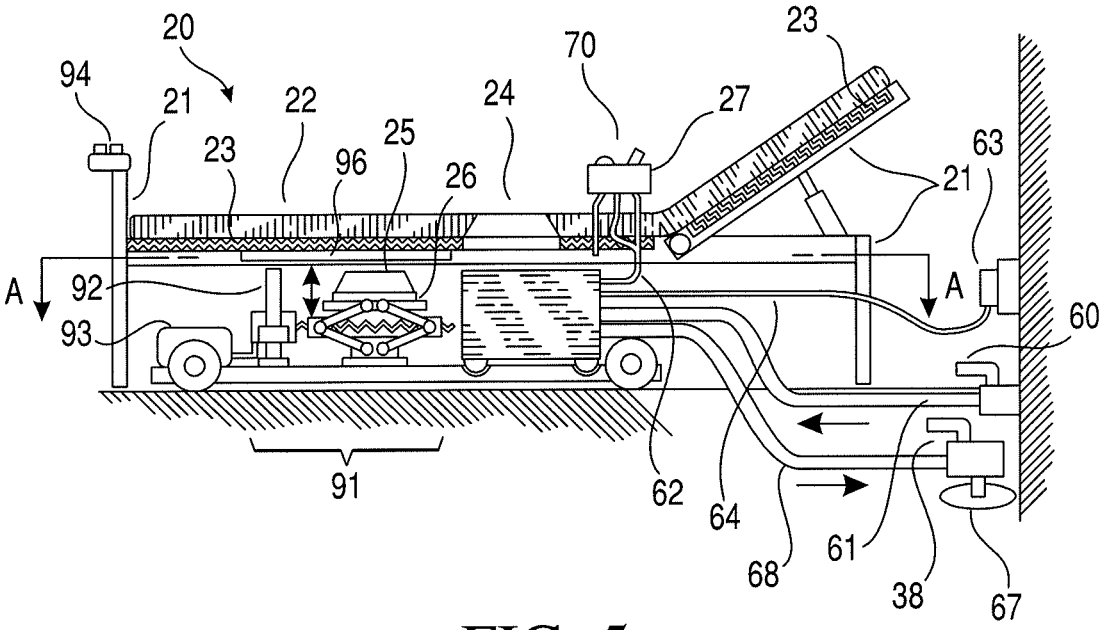
FIG. 5 is a schematic illustration of a robotic system as used in a further embodiment of the invention.
Figure 6:
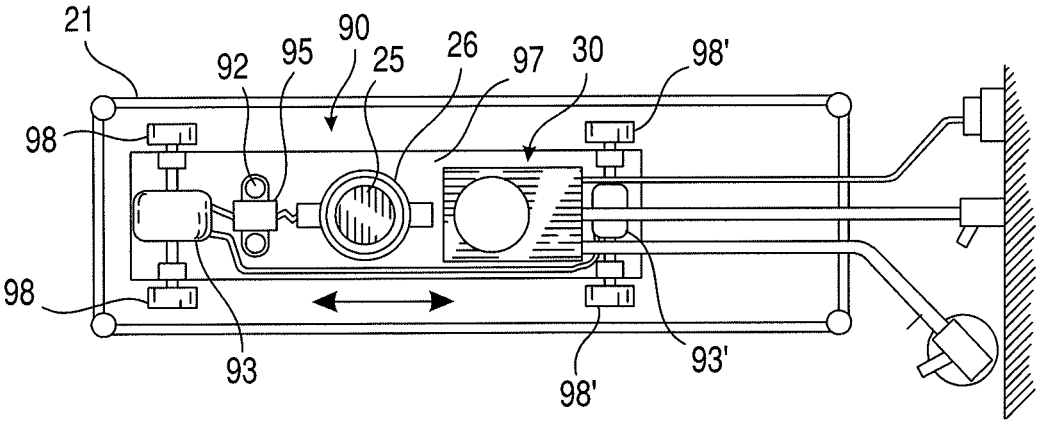
FIG. 6 is a schematic or plan view of the system shown in FIG. 5.

A bed 20 with a toilet unit 30 for a patient is illustrated in FIGS. 5 and 6. The bed includes:

- a frame 21 with a mattress 22, mattress support 23 and wherein a mattress and mattress support include an opening 24 in an intermediate portion thereof and a cushion 25 that fills the opening 24 and is fixed to a support 26 which is fixed on a servo mechanism 91.
- a robotic system 90 is associated with the bed 20 and consists of a frame 97, servo control and driving unit 93, driving unit 93', four wheels 98 and 98' and a servo mechanism 91 (see FIG. 5). The robotic system 90 moves on the floor or on a set of tracks under the bed 20 and carries the toilet module 30. The robot is guided by sensors 92 and guiding line 96 located under the mattress support 23. A member of a nursing staff may operate the robot from a wireless remote unit 94 which sends one of two commands to the robot control and driving units 93. The unit 93 drives two wheels 98. Further, a control signal to the driving unit 93' drives wheels 98'. The control and driving unit 93 also controls the operation so that the cushion 25 is lowered down and the toilet module centered under the second opening 24. When the toilet is not needed a command from the control unit 94 causes the robot 90 to move toward the head of the bed 20 until the cushion 25 is centered under the opening 24, then stops and the servo mechanism 91 moves the cushion 25 upward by means of a scissor like mechanism until it fills the opening 24. When the toilet is needed a command from the control unit 94 causes the servo mechanism 91 to lower the cushion downward and robot 90 moves toward the foot end of the bed 20 until toilet unit 30 is aligned under the opening 24 and then stops.

The toilet unit 30 is supported at a fixed location on the robot frame 97 and is supplied by pure water from a tap 60 through a hose 61 and it discharges liquidized waste to a sewage outlet 67 through a hose 68 and valve 38 in a residence. The toilet module 30 is supplied by AC electric energy from a socket/plug 63 through cable 64 and is connected to a second remote control unit 70 which is available to a patient by means of a multi-core cable 62. The second control unit 70 has a plurality of switches indicating lamps and a buzzer that gives the user facility to control and monitor the operation of the toilet unit 30.

The bed 20 as shown in FIGS. 5 and 6 has the opening 24 positioned in an intermediate position in the mattress. Different models for the bed 20 can be manufactured with openings 24 positioned in other locations to match different cases for the patients and their comfort. For example, FIG. 1 shows a side mounted toilet 30 for use by a patient that is able to sit upright in bed and swing their legs over the side of the bed.

While the invention has been described in connection with its preferred embodiments it should be recognized that changes and modifications may be made therein without departing from the scope of the appended claims.

What is claimed is:

1. A bed with an integral toilet for a bedridden patient, said bed comprising:

a bed having a frame, a mattress, and a support for supporting said mattress on said bed frame and wherein said mattress and support define a first opening extending through said mattress and said support in an intermediate portion thereof;

a flush toilet having a lower portion removably disposed underneath said first opening and including an integral bidet, a source of clean water, a nozzle, a variable speed pump and means for connecting said source of clean water, said bidet, said pump and said nozzle;

a second opening in said lower portion of said toilet, a waste storage chamber and a conduit connecting said second opening to at least one of a sewer drain in a building or said waste storage chamber for receiving liquefied waste and water from said toilet, means for absorbing odor from said waste;

means for directing clean water from said bidet onto a patient for cleaning the patient;

a hot air dryer including means for directing hot air onto a portion of a patient for drying any water remaining on the patient from said bidet; and a remotely control device for delivering water to said bidet and said nozzles for cleaning a patient and said toilet and for opening and closing said first and second openings, a robotic means for laterally moving a toilet module on a track in a first direction to align said toilet module with said first opening, and laterally moving said toilet module on said track in a second direction to align a cushion with said first opening; and, means for raising and lowering said cushion to place and remove said cushion within said first opening.

2. A bed with an integral toilet for a bed ridden patient according to claim in which said at least one of said conduit of second opening connection is to said sewer drain in a building.

3. A bed with an integral toilet according to claim 2 which includes a plurality of nozzles.

4. A bed with an integral toilet according to claim 3 in which said odor eliminator includes an actuated aromatic spray upon flushing said toilet.

5. A bed with an integral toilet according to claim 4 in which said odor eliminator is activated independently of said toilet.

6. A bed with an integral toilet according to claim 5 which includes remotely controlled cover for said first opening and a separate cushion for filling said opening in said mattress.

7. A bed with an integral toilet according to claim 6 which includes means for connecting said bed to a source of AC electrical energy for powering a heater for heating air, a pump for pumping water and means for opening and closing said first and second openings as well as raising and lowering portions of said bed.

8. A bed with an integral toilet according to claim 6 which includes batteries and a plurality of DC motors for energizing and operating said bed and said toilet.

9. A bed with an integral toilet according to claim 6 which includes means for connecting said toilet to the plumbing system in a residence for supplying clean water and to a sewer line in the residence for disposing of waste from said toilet.

10. A bed with an integral toilet for a bed ridden patient according to claim in which said at least one of said conduit of second opening connection is to said waste storage chamber.

* * * * *